US010330043B2

(12) United States Patent
Okada et al.

(10) Patent No.: US 10,330,043 B2
(45) Date of Patent: Jun. 25, 2019

(54) SADDLE-RIDE TYPE VEHICLE

(71) Applicant: HONDA MOTOR CO., LTD., Tokyo (JP)

(72) Inventors: Nozomi Okada, Wako (JP); Yusaburo Tani, Wako (JP); Yosuke Hoi, Wako (JP); Tatsuhiko Asano, Wako (JP); Shuichi Ishida, Wako (JP); Isao Azumagakito, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 67 days.

(21) Appl. No.: 15/711,188

(22) Filed: Sep. 21, 2017

(65) Prior Publication Data

US 2018/0094601 A1 Apr. 5, 2018

(30) Foreign Application Priority Data

Sep. 30, 2016 (JP) ..... 2016-192850

(51) Int. Cl.
*F01N 13/00* (2010.01)
*F02F 1/42* (2006.01)
(Continued)

(52) U.S. Cl.
CPC ..... *F02F 1/42* (2013.01); *F01N 13/1805* (2013.01); *F02B 61/02* (2013.01); *F02D 9/1035* (2013.01);
(Continued)

(58) Field of Classification Search
CPC ..... F02F 1/42; F02F 7/006; F02F 2001/244; F01N 13/1805; F01N 2590/04; F02B 61/02; F02D 9/1035; F02D 11/04; F02M 35/162
(Continued)

(56) References Cited

U.S. PATENT DOCUMENTS 4,727,953 A 3/1988 Kudo et al.
5,458,099 A * 10/1995 Koller ..... F01L 1/0532 123/193.5
(Continued)

FOREIGN PATENT DOCUMENTS

DE 10359221 A1 7/2004
JP 59-97186 U 7/1984
(Continued)

OTHER PUBLICATIONS

Extended European Search Report, dated Feb. 21, 2018, for European Application No. 17185699.0.
(Continued)

*Primary Examiner* — Marguerite J McMahon
(74) *Attorney, Agent, or Firm* — Birch, Stewart, Kolasch & Birch, LLP

(57) ABSTRACT

In a saddle-ride type vehicle in which a cylinder head of a single-cylinder engine main unit has a front wall and a rear wall, an exhaust system being connected to the front wall and an intake system being connected to the rear wall, a joining surface of the cylinder head to a head cover is formed on a plane crossing a cylinder axis, the plane being inclined downward toward a front. Rotation axes of camshafts are arranged on the plane. An axis of a valve stem of a throttle valve is arranged on the plane. A curve cover curved so as to cover driven sprockets fixed to the camshafts is formed on one side in a vehicle width direction of the head cover. A drum housing box housing a throttle drum fixed to one end of the valve stem is arranged close to the curve cover.

11 Claims, 10 Drawing Sheets

(51) Int. Cl.

| | |
|---|---|
| ***F01N 13/18*** | (2010.01) |
| ***F02F 7/00*** | (2006.01) |
| ***F02M 35/16*** | (2006.01) |
| ***F02D 9/10*** | (2006.01) |
| ***F02D 11/04*** | (2006.01) |
| ***F02B 61/02*** | (2006.01) |
| *F02F 1/24* | (2006.01) |

(52) U.S. Cl.
CPC ..... *F02D 11/04* (2013.01); *F02F 7/006* (2013.01); *F02M 35/162* (2013.01); *F01N 2590/04* (2013.01); *F02F 2001/244* (2013.01)

(58) Field of Classification Search
USPC ..... 123/193.5, 90.27
See application file for complete search history.

(56) References Cited

U.S. PATENT DOCUMENTS

| | | | | |
|---|---|---|---|---|
| 7,243,490 | B2 | 7/2007 | Yoshida et al. | |
| 2001/0018902 | A1* | 9/2001 | Tsukui ..... | F01L 1/143 123/90.5 |
| 2004/0123591 | A1 | 7/2004 | Yoshida et al. | |
| 2008/0223348 | A1 | 9/2008 | Togasawa | |
| 2010/0147273 | A1 | 6/2010 | Akiyama et al. | |
| 2010/0242885 | A1 | 9/2010 | Tabinoki et al. | |
| 2011/0073063 | A1 | 3/2011 | Tadokoro et al. | |
| 2015/0267592 | A1 | 9/2015 | Sakai et al. | |
| 2016/0003185 | A1* | 1/2016 | Krenn ..... | F02F 7/0053 123/193.3 |

FOREIGN PATENT DOCUMENTS

| | | | |
|---|---|---|---|
| JP | 61-202992 | A | 9/1986 |
| JP | 61-261630 | A | 11/1986 |
| JP | 63-64887 | A | 3/1988 |
| JP | 3-271091 | A | 12/1991 |
| JP | 8-74571 | A | 3/1996 |
| JP | 2000-337167 | A | 12/2000 |
| JP | 2001-280435 | A | 10/2001 |
| JP | 2005-106036 | A | 4/2005 |
| JP | 2007-231766 | A | 9/2007 |
| JP | 2008-38683 | A | 2/2008 |
| JP | 2008-223596 | A | 9/2008 |
| JP | 2008-286046 | A | 11/2008 |
| JP | 2009-74458 | A | 4/2009 |
| JP | 2010-229830 | A | 10/2010 |
| JP | 2011-21522 | A | 2/2011 |
| JP | 2011-68250 | A | 4/2011 |
| JP | 2016-65458 | A | 4/2016 |
| JP | 5913410 | B2 | 4/2016 |

OTHER PUBLICATIONS

Japanese Office Action, dated Feb. 27, 2019, for Japanese Application No. 2016-192850, with an English machine translation.

* cited by examiner

SADDLE-RIDE TYPE VEHICLE

BACKGROUND OF THE INVENTION

Field of the Invention

The present invention relates to a saddle-ride type vehicle in which a single-cylinder engine main unit is mounted on a body frame, the engine main unit having: a crankcase; a cylinder body rising upward from an upper portion of the crankcase; a cylinder head connected to an upper portion of the cylinder body; and a head cover connected to an upper portion of the cylinder head, the cylinder head includes a front wall connected to an exhaust system and a rear wall connected to an intake system.

Description of the Related Art

Such a saddle-ride type vehicle is disclosed in Japanese Patent No. 5913410 for example.

Incidentally, in the vehicle disclosed in Japanese Patent No. 5913410, output of an internal combustion engine is enhanced by devising arrangement of an intake system and an exhaust system of the internal combustion engine with respect to a body frame, however, further enhancement of the output is desired and a problem to be solved is to concentrate and compact mass of the internal combustion engine.

SUMMARY OF THE INVENTION

The present invention has been achieved in view of the above-mentioned circumstances, and it is an object thereof to provide a saddle-ride type vehicle that enhances output of an internal combustion engine and enables concentrating and compacting mass of the internal combustion engine.

In order to achieve the object, according to a first feature of the present invention, there is provided a saddle-ride type vehicle in which a single-cylinder engine main unit is mounted on a body frame, the engine main unit having: a crankcase; a cylinder body rising upward from an upper portion of the crankcase; a cylinder head connected to an upper portion of the cylinder body; and a head cover connected to an upper portion of the cylinder head, the cylinder head includes a front wall connected to an exhaust system and a rear wall connected to an intake system, wherein a joining surface of the cylinder head to the head cover is formed on a plane crossing a cylinder axis, the plane being inclined downward toward a front, rotation axes of camshafts are arranged on the plane, the rotation axes of camshafts configuring a part of a valve train opening/closing an intake valve and an exhaust valve respectively supported by the cylinder head, an axis of a valve stem of a butterfly throttle valve is arranged on the plane, the butterfly throttle valve being provided to a throttle device configuring a part of the intake system, a curve cover is formed on one side in a vehicle width direction of the head cover, the curve cover being curved to cover driven sprockets that are fixed to the camshafts so that a cam chain for transmitting power from a crankshaft to the camshafts is wound around the driven sprockets, and a drum housing box is arranged close to the curve cover, the drum housing box housing a throttle drum fixed to one end of the valve stem, the drum housing box being annexed to the throttle device.

With the first feature of the present invention, as the joining surface of the cylinder head to the head cover is formed on the plane crossing the cylinder axis, the plane being inclined diagonally downward toward the front, the rotation axis of the camshaft configuring a part of the valve train is arranged on the plane, the axis of the valve stem of the butterfly throttle valve provided to the throttle device configuring a part of the intake system is arranged on the plane, the curve cover curved to cover the driven sprocket fixed to the camshaft on one side in the vehicle width direction of the head cover is formed, and the drum housing box housing the throttle drum and annexed to the throttle device is arranged close to the curve cover, the throttle valve is arranged closer to the engine main unit so as to enable concentration and compactness of the intake system, the intake system can be made a greatly inclined downdraft type so that the output of the internal combustion engine can be enhanced, and besides, the handling of the throttle cables extended from the drum housing box is facilitated.

According to a second feature of the present invention, in addition to the first feature, the head cover includes a rear wall formed with a relief recess corresponding to the drum housing box.

With the second feature of the present invention, as the relief recess is formed on the rear wall of the head cover, the drum housing box can be brought closer to the head cover side and it is possible to achieve concentration and compactness of the intake system.

According to a third feature of the present invention, in addition to the second feature, a cam chain passage through which the cam chain is traveled is formed in the engine main unit, a lead-out pipe for leading out breather gas is installed in the rear wall of the head cover, and the relief recess is arranged between the cam chain passage and the lead-out pipe when viewed from a direction along the cylinder axis.

With the third feature of the present invention, as the relief recess of the head cover is arranged between the cam chain passage and the lead-out pipe, a dead space can be effectively utilized.

According to a fourth feature of the present invention, in addition to the first feature, the body frame includes: a head pipe that steerably supports a steering handlebar; a pair of right and left main frames extended backward from the head pipe; a pair of right and left pivot frames connected to rear ends of the main frames, the pair of pivot frames being extended downward; and a single down frame extended downward from the head pipe, the engine main unit is arranged so as to be encircled by the head pipe, the main frames, the pivot frames and the down frame as seen in a side view, and a pair of exhaust ports are mutually independently formed in the cylinder head so that the pair of exhaust ports are arranged on opposite sides of a center line of a vehicle body passing a center in the vehicle width direction of the down frame as seen in a plan view, the pair of exhaust ports respectively corresponding to a pair of exhaust valves openably and closably arranged in the cylinder head, the pair of exhaust ports being open to the front wall of the cylinder head.

With the fourth feature of the present invention, as the pair of exhaust ports respectively corresponding to the pair of exhaust valves are formed in the cylinder head so as to be arranged on opposite sides of the center line of the vehicle body passing the center line in the vehicle width direction of the down frame, the curve of the exhaust port is reduced so that the output can be enhanced, and the cylinder head can be arranged close to the down frame while easily avoiding interference with the exhaust pipes connected to the pair of exhaust ports.

According to a fifth feature of the present invention, in addition to the fourth feature, exhaust pipes configuring a part of the exhaust system and respectively connected to the pair of exhaust ports integrally includes: a curved pipe portion having an upstream end connected to each exhaust port, the curved pipe portion being bent in a U shape beside the down frame; and an inclined linear pipe portion having an upstream end connected to a downstream end of the curved pipe portion, the inclined linear pipe portion being extended backward while inclined to be located inside in the vehicle width direction as going toward the rear, the inclined linear pipe portions are arranged so as to pass between the pair of right and left pivot frames, and an inclined face along the inclined linear pipe portion of one of the pair of exhaust pipes is formed in a protruded portion of a cam chain tensioner protruded from the rear wall of the cylinder head, the cam chain tensioner being provided to the rear wall of the cylinder head so as to adjust tension of the cam chain.

With the fifth feature of the present invention, as the exhaust pipe is integrally provided with the curved pipe portion bent in the U shape beside the down frame and the inclined linear pipe portion having the upstream end connected to the downstream end of the curved pipe portion, the inclined linear pipe portion being extended backward while inclined so as to be located inside in the vehicle width direction as going toward the rear, the inclined linear pipe portion passing between the pair of right and left pivot frames, and the inclined face along one of the pair of inclined linear pipe portions is formed in the protruded portion of the cam chain tensioner protruded from the rear wall of the cylinder head, the compact arrangement of the pair of exhaust pipes is enabled, avoiding interference with the cam chain tensioner.

According to a sixth feature of the present invention, in addition to the fifth feature, a rotor of a generator is fixed to one end of the crankshaft, a cam chain-driving sprocket for engaging the cam chain therewith is provided to an other end side of the crankshaft in a portion where a cylinder bore of the cylinder body is sandwiched between the portion and the generator, and a power transmission mechanism for starting that transmits power for starting from a starter motor installed in the crankcase to the crankshaft is arranged between the generator and the cylinder bore.

With the sixth feature of the present invention, as the generator and the cam chain-driving sprocket are separately arranged in the direction along the axis of the crankshaft and the power transmission mechanism for starting is arranged on the generator side, the sideway overhang of the cam chain passage from the cylinder bore is inhibited, the exhaust pipe can be arranged closer to the center side of the vehicle body beside the cylinder body and the cylinder head, and the more compact arrangement of the exhaust pipe is enabled.

According to a seventh feature of the present invention, in addition to the sixth feature, a front end of a swing arm is swingably supported by the pivot frames via a pivot, a rear end of the swing arm pivotally supporting a rear wheel, a rear cushion unit that buffers a swing of the swing arm is extended up and down and the rear cushion unit is arranged between the pair of right and left pivot frames, the pair of right and left exhaust pipes pass respectively between the pair of right and left pivot frames and the rear cushion unit and are extended backward, and exhaust mufflers are respectively connected to downstream ends of the exhaust pipes.

With the seventh feature of the present invention, as the exhaust pipe is arranged between the rear cushion unit that buffers the swing of the swing arm and each of the pair of right and left pivot frames, and the right and left exhaust pipes are similar and symmetrical, a part of members configuring the exhaust pipes can be shared between the right and left exhaust pipes.

According to an eighth feature of the present invention, in addition to the sixth feature or the seventh feature, the down frame is provided with a pair of side walls that are inclined so as to approach each other as going to the rear in a longitudinal direction of the vehicle while respectively facing the curved pipe portions of the exhaust pipes.

With the eighth feature of the present invention, as the down frame is provided with the pair of side walls inclined to approach each other as going toward the rear in the longitudinal direction of the vehicle, the space for arranging the exhaust pipes can be readily secured on opposite sides of the down frame, the bend of the exhaust pipe is reduced so that exhaust performance can be enhanced.

According to a ninth feature of the present invention, in addition to the fourth feature or the fifth feature, a center in the vehicle width direction of the down frame, the cylinder axis and a center of an intake port open to the rear wall of the cylinder head are arranged on the center line of the vehicle body as seen in the plan view.

With the ninth feature of the present invention, as the center of the down frame, the cylinder axis and the center of the intake port are located on the center line of the vehicle body as seen in a plan view, the influence of bias in a right-left direction of intake and exhaust is inhibited to be smaller so that the output can be enhanced.

The above and other objects, characteristics and advantages of the present invention will be clear from detailed descriptions of the preferred embodiment which will be provided below while referring to the attached drawings.

DESCRIPTION OF THE PREFERRED EMBODIMENT

Referring to attached FIGS. 1 to 10, an embodiment of the present invention will be described below. In the following description, up-down, front-rear and right-left directions shall be directions viewed from a rider straddling a two-wheeled motor vehicle.

Figure 1:
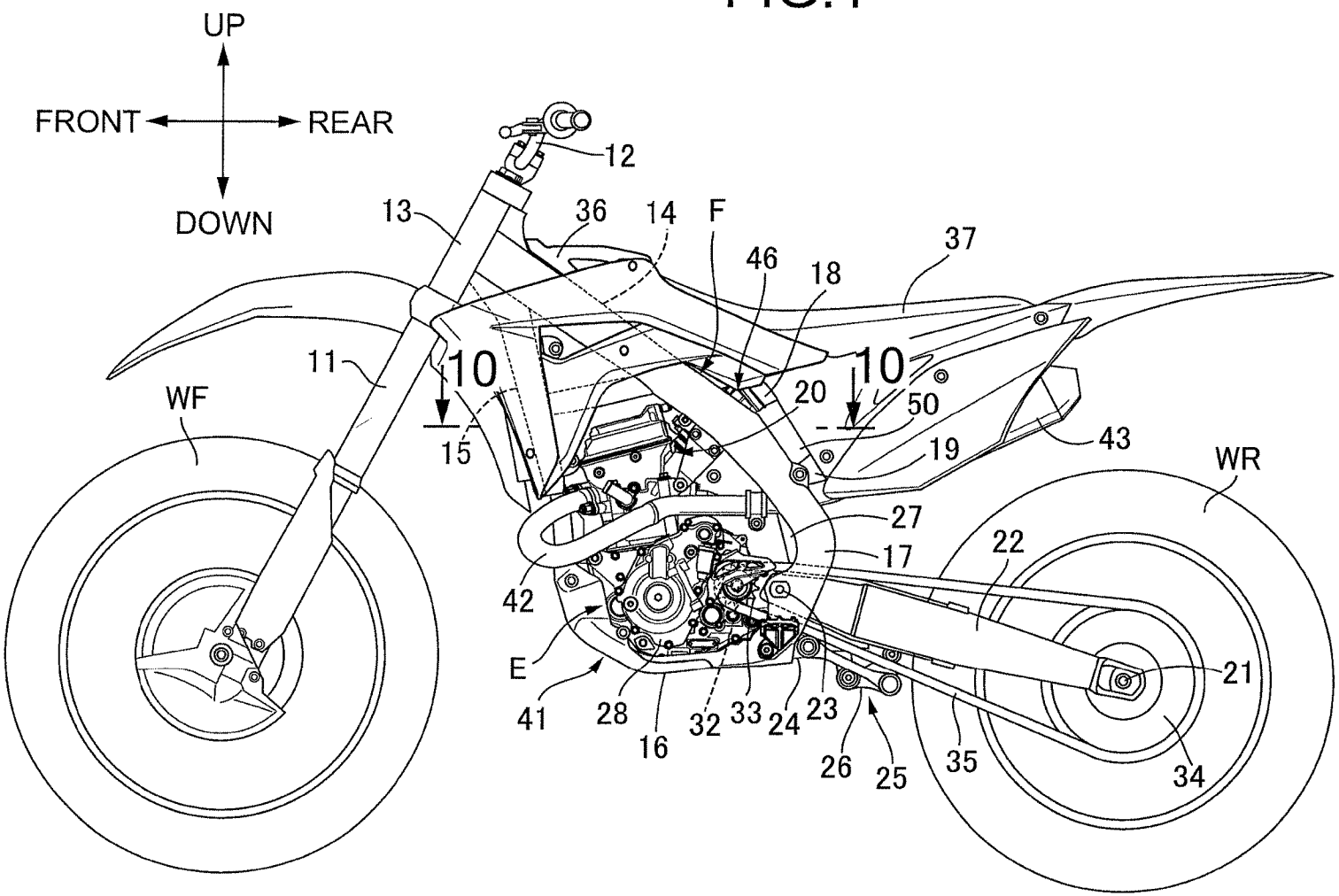
FIG. 1 is a left side view of a two-wheeled motor vehicle.

First as shown in FIG. 1, a body frame F of a two-wheeled motor vehicle for traveling on an uneven road is provided with a head pipe 13, a pair of right and left main frames 14, a down frame 15, a pair of right and left lower frames 16, a pair of right and left pivot frames 17, a pair of right and left seat rails 18, and a pair of right and left rear frames 19. The head pipe 13 steerably supports a front fork 11 pivotally supporting a front wheel WF and a steering handlebar 12. The main frames 14 are extended downward to the rear from the head pipe 13. The down frame 15 is extended downward to the rear from the head pipe 13 at a steeper angle than each main frame 14. The lower frames 16 are connected to a lower end of the down frame 15 and extended backward. The pivot frames 17 each have an upper end integrally connected to a rear end of each main frame 14 and are extended downward, the pivot frames 17 each having a lower end connected to a rear end of each lower frame 16. The seat rails 18 are connected to the rear end of each main frame 14 and extended backward. The rear frames 19 each have a front end coupled to an intermediate portion in an up-down direction of each of the pivot frames 17 and are extended upward to the rear, the rear frames 19 each having a rear end coupled to each pivot frame 17.

An engine main unit 20 of a single-cylinder internal combustion engine E is mounted on the body frame F in a state encircled by the head pipe 13, the main frames 14, the down frame 15, the lower frames 16, and the pivot frames 17 as seen in a side view. An axle 21 of a rear wheel WR as a drive wheel is pivotally supported on a rear end of a swing arm 22 and a front end of the swing arm 22 is supported swingably in the up-down direction by a lower portion of the pivot frame 17 via a pivot 23 in the body frame F.

A link mechanism 25 is provided between a bracket 24 provided to the lower portion of the pivot frame 17 in the body frame F and the swing arm 22 and an up-down extended rear cushion unit 27 is provided between a link member 26 configuring a part of the link mechanism 25 and an upper portion of the pivot frame 17.

A transmission 52 (see FIG. 4) is housed in a crankcase 28 configuring a part of the engine main unit 20, an output shaft 32 of the transmission 52 is protruded leftward from the crankcase 28, and an endless drive chain 35 is wound onto a drive chain-driving sprocket 33 provided to the output shaft 32 and a driven sprocket 34 provided to the axle 21 of the rear wheel WR.

Besides, a fuel tank 36 is provided on both main frames 14 above the engine main unit 20, and a riding seat 37 is arranged at the back of the fuel tank 36 with the riding seat 37 supported by the seat rails 18.

Figure 2:
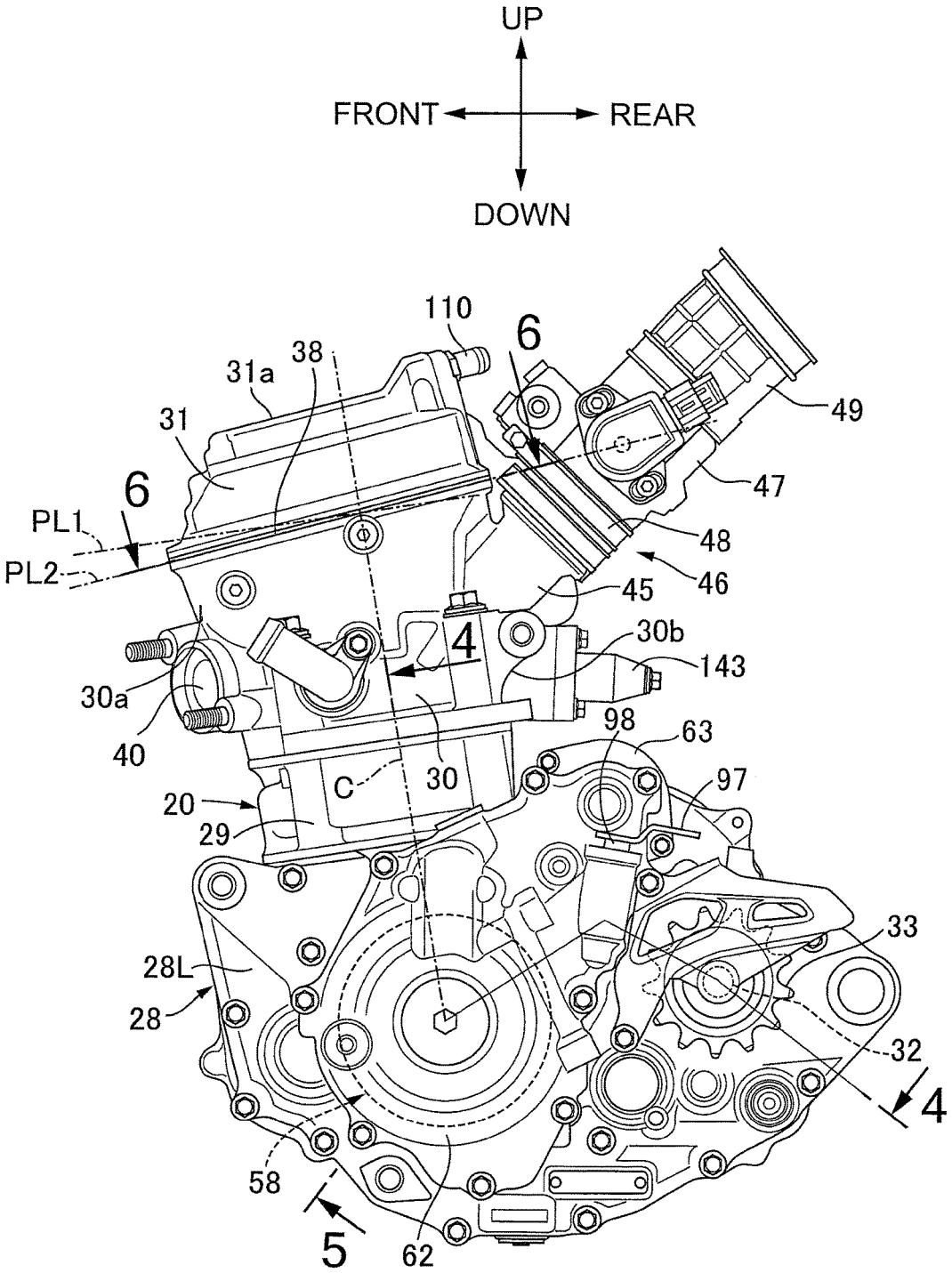
FIG. 2 is a left side view of an internal combustion engine.
Figure 3:
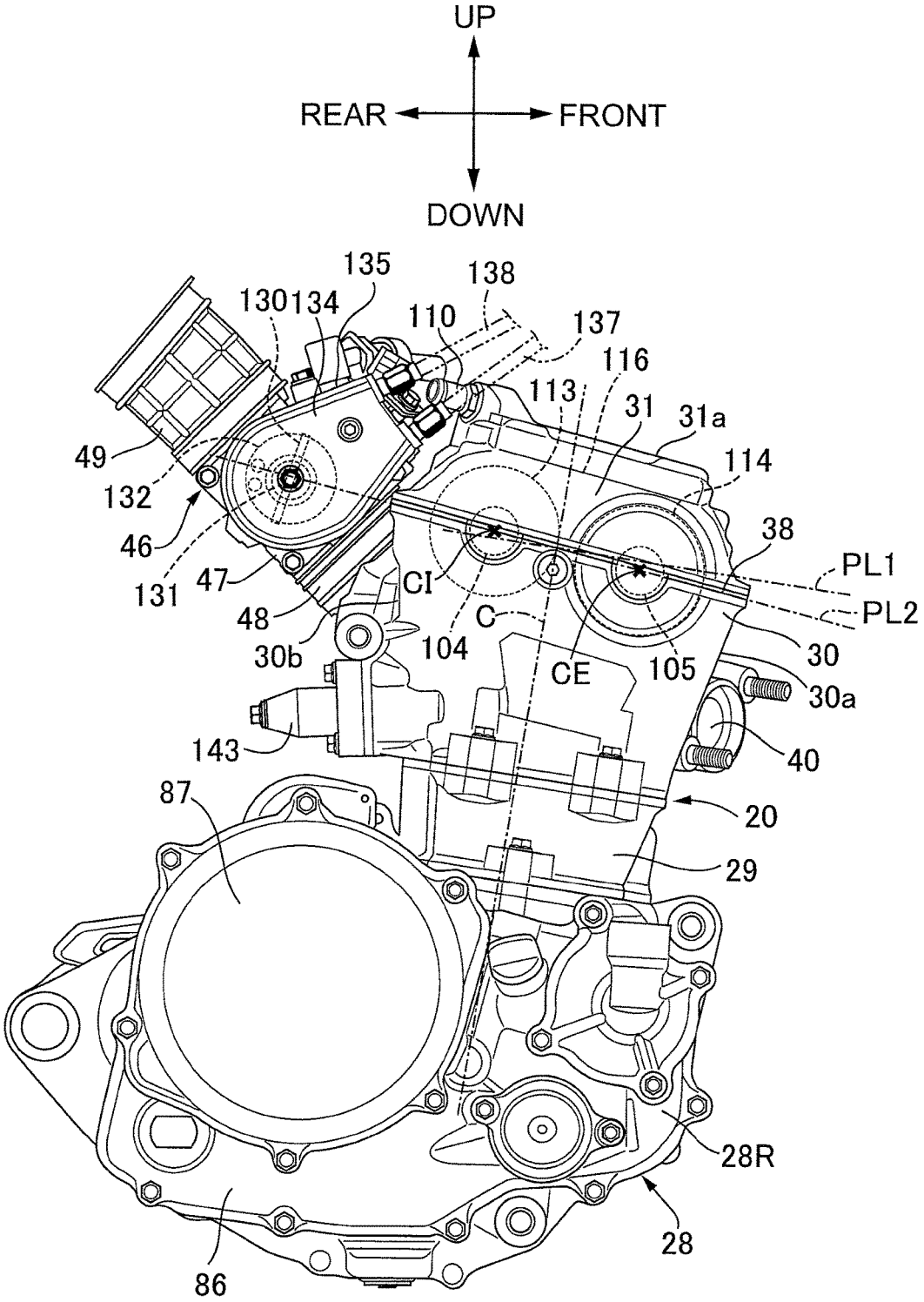
FIG. 3 is a right side view of the internal combustion engine.

As also shown in FIGS. 2 and 3, the engine main unit 20 is provided with the crankcase 28, a cylinder body 29, a cylinder head 30 and a head cover 31, and the engine main unit 20 is mounted on the body frame F in such posture that a cylinder axis C is slightly inclined forward. The cylinder body 29 is connected to a front-side upper portion of the crankcase 28 in a state rising upward from the crankcase 28. The cylinder head 30 is connected to an upper portion of the cylinder body 29. The head cover 31 is connected to an upper portion of the cylinder head 30. Moreover, a joining surface 38 of the cylinder head 30 to the head cover 31 is located on a second plane PL2 crossing the cylinder axis C, the second plane PL2 being inclined downward to the front so that a forward inclined angle thereof is slightly larger than that of a first plane PL1 perpendicular to the cylinder axis C and inclined so as to be located upward as going rearward in a longitudinal direction of a vehicle.

A pair of right and left exhaust ports 40 open to a front wall 30*a* of the cylinder head 30 are provided to the cylinder head 30, and an exhaust system 41 of the internal combustion engine E is provided with a pair of exhaust pipes 42 and a pair of right and left exhaust mufflers 43 as plainly shown in FIG. 1. Upstream ends of the exhaust pipes 42 are connected to the exhaust ports 40 and the exhaust pipes 42 extend respectively around the right and left sides of the engine main unit 20. The exhaust mufflers 43 are respectively connected to downstream ends of the exhaust pipes 42 and arranged above the rear wheel WR.

In addition, an intake connecting pipe 45 forming a single intake port 44 is protruded backward and diagonally upward from a rear wall 30*b* of the cylinder head 30, and an intake system 46 of the internal combustion engine E is provided with a throttle body 47, an insulator 48, a connecting tube 49, and an air cleaner 50 (see FIG. 1). The throttle body 47 is a throttle device for regulating air volume supplied to the intake port 44. The insulator links the intake connecting pipe 45 and the throttle body 47. A downstream end of the connecting tube 49 is connected to an upstream end of the throttle body 47. The air cleaner 50 is connected to an upstream end of the connecting tube 49 and arranged below the riding seat 37.

Figure 4:
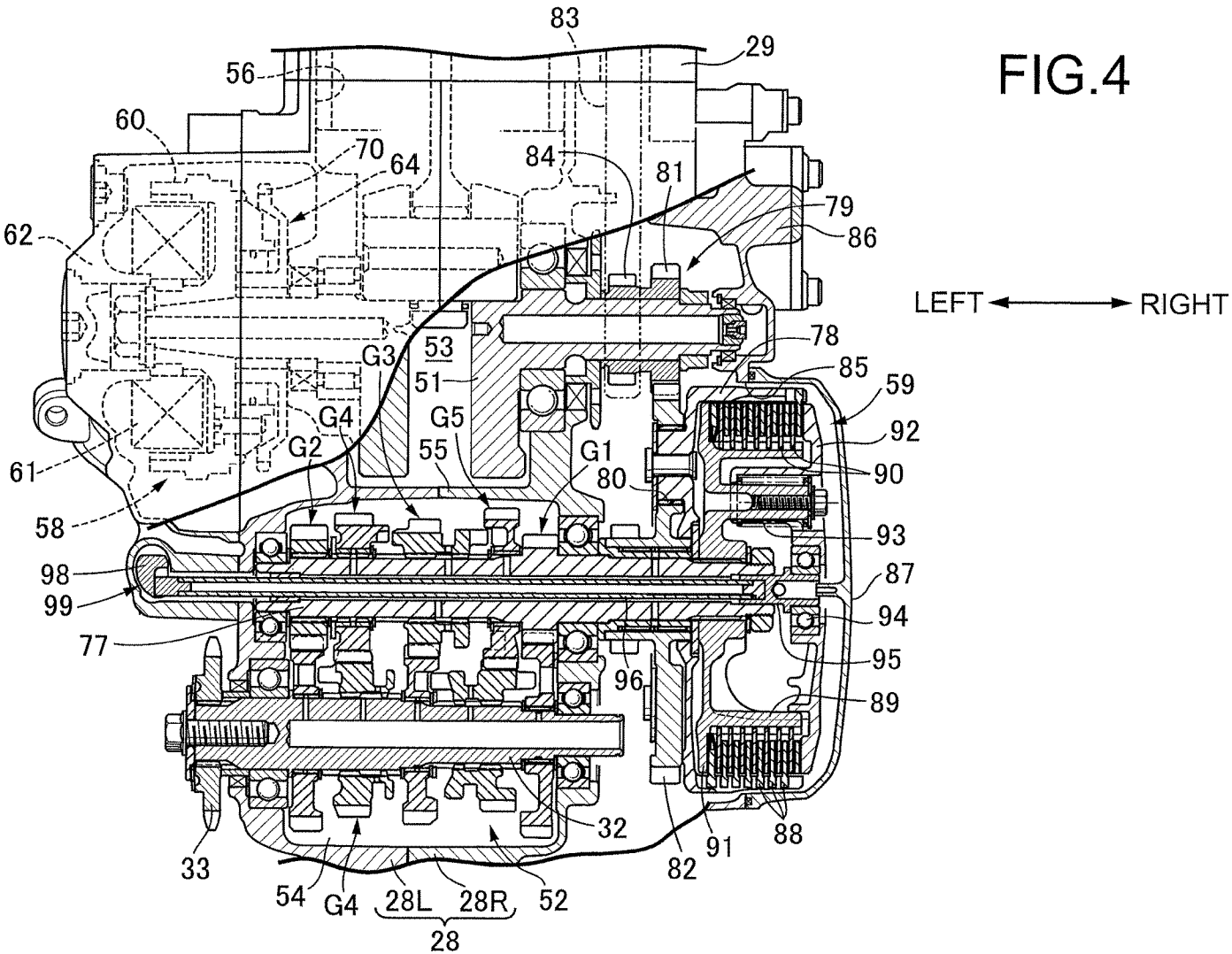
FIG. 4 is a sectional view viewed along a line 4-4 in FIG. 2.

As shown in FIG. 4, the crankcase 28 is configured by connecting a left case half 28L arranged on the left side in a vehicle width direction and a right case half 28R arranged on the right side in the vehicle width direction, and in the crankcase 28, a crankshaft 51 having an axis extended in the vehicle width direction is rotatably supported.

In the crankcase 28, a crank chamber 53 housing a principal part of the crankshaft 51 and a transmission chamber 54 housing the transmission 52 are formed with a partition wall 55 interposed between both chambers, and in the cylinder body 29, a cylinder bore 56 communicating with the crank chamber 53 is formed.

A generator 58 driven by the crankshaft 51 and a clutch 59 interposed between the crankshaft 51 and the transmission 52 are arranged respectively on opposite sides in an axial direction of the crankshaft 51, and in this embodiment, the generator 58 is arranged on the left side in the axial direction of the crankshaft 51, and the clutch 59 is arranged on the right side in the axial direction of the crankshaft 51.

Figure 5:
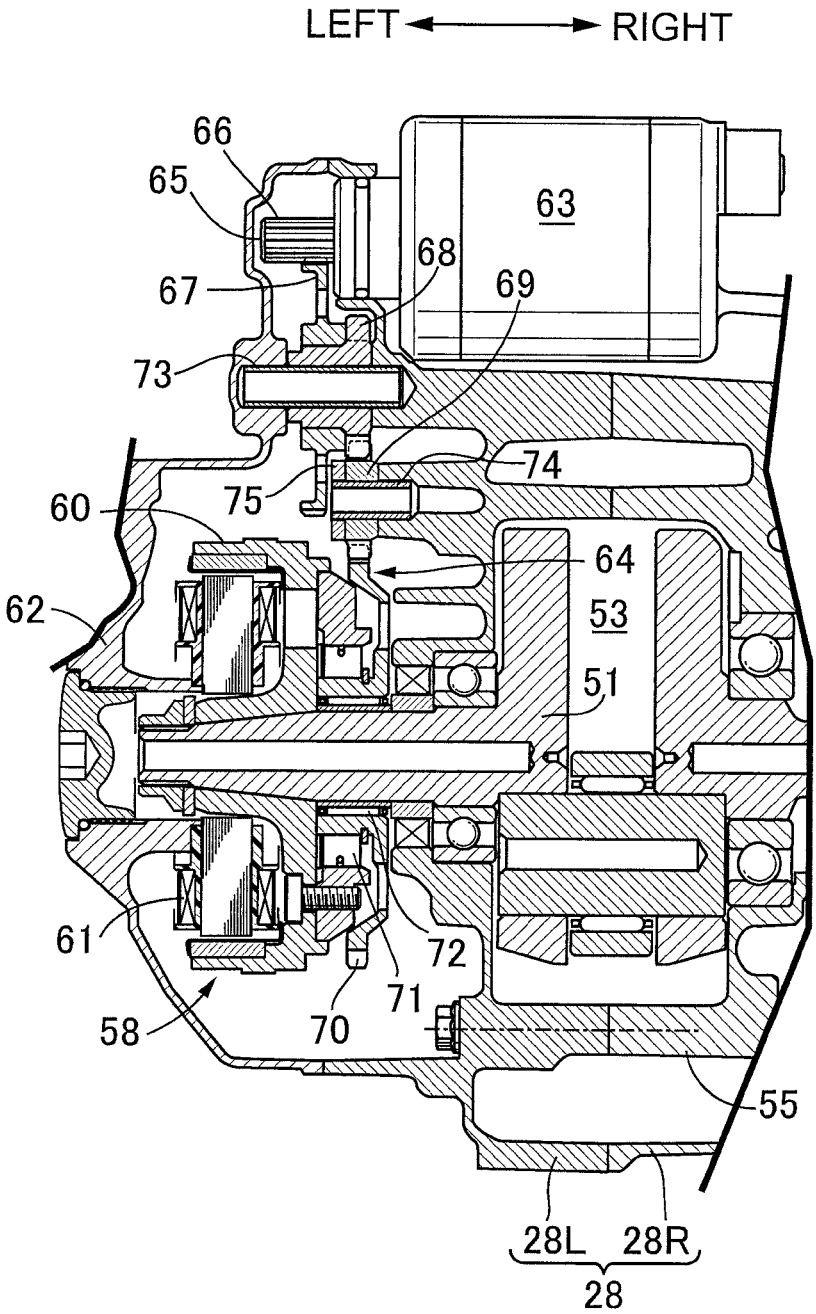
FIG. 5 is a sectional view viewed along a line 5-5 in FIG. 2.

Also referring to FIG. 5, the generator 58 is provided with a rotor 60 fixed to the crankshaft 51 and a stator 61 arranged in the rotor 60, and the stator 61 is fixed to a crankcase cover 62 fastened to the left case half 28L of the crankcase 28 with the crankcase cover 62 covering the generator 58.

Paying attention to FIG. 4, a power transmission mechanism 64 for starting that transmits torque for starting from a starter motor 63 to the crankshaft 51 is arranged between the cylinder bore 56 of the cylinder body 29 and the generator 58 in the axial direction of the crankshaft 51, and the power transmission mechanism 64 for starting is covered with the crankcase cover 62 together with the generator 58 from the opposite side to the clutch 59.

The starter motor 63 is arranged in the upper portion of the crankcase 28 at the back of the cylinder body 29 in the longitudinal direction of the vehicle, and the power transmission mechanism 64 for starting is provided with a driving gear 66, a first intermediate gear 67, a second intermediate gear 68, a third intermediate gear 69, and a driven gear 70. The driving gear 66 is provided to a motor shaft 65 of the starter motor 63, the first intermediate gear 67 is engaged with the driving gear 66, the second intermediate gear 68 is turned together with the first intermediate gear 67 and arranged coaxially with the first intermediate gear 67, the third intermediate gear 69 is engaged with the second intermediate gear 68, and the driven gear 70 is engaged with the third intermediate gear 69. A one-way clutch 71 is interposed between the driven gear 70 and the rotor 60 of the generator 58, the driven gear 70 being coaxially arranged with the crankshaft 51, and a needle bearing 72 is inserted between the crankshaft 51 and the driven gear 70.

The second intermediate gear 68 is formed to have a smaller diameter than that of the first intermediate gear 67 and integrated with an intermediate rotating shaft 73 having axial opposite ends rotatably supported by the left case half 28L of the crankcase 28 and the crankcase cover 62. The first intermediate gear 67 is fixed to the intermediate rotating shaft 73 in a position sandwiching the second intermediate gear 68 between the first intermediate gear 67 and the left case half 28L. The third intermediate gear 69 is turnably supported by a supporting shaft 74 having one end press-fitted to and supported on the left case half 28L of the crankcase 28, and a disc-shaped regulating plate 75 sandwiching the third intermediate gear 69 between the regulating plate 75 and the left case half 28L of the crankcase 28 is fixed to the other end of the supporting shaft 74.

Referring to FIG. 4 again, the transmission 52 is provided with gear trains of a plurality of gear shift stages capable of being selectively established, for example first to fifth speed gear trains G1, G2, G3, G4, G5, between an input shaft 77 having an axis parallel to the crankshaft 51 and rotatably supported by the left and right case halves 28L, 28R and the output shaft 32 having an axis parallel to the input shaft 77 and rotatably supported by both case halves 28L, 28R, and the drive chain-driving sprocket 33 is fixed to a protruded end of the output shaft 32 protruded from the left case half 28L.

Respective right ends in the vehicle width direction of the crankshaft 51 and the input shaft 77 are protruded from the right case half 28R of the crankcase 28, the clutch 59 for switching connection/disconnection of power between the crankshaft 51 and the input shaft 77 is mounted on the right end of the input shaft 77, and rotational power of the crankshaft 51 is transmitted to a clutch outer 78 of the clutch 59 via a primary speed-reduction device 79 and a damper 80. The primary speed-reduction device 79 is configured with a primary driving gear 81 fixed to the right end of the crankshaft 51 and a primary driven gear 82 engaged with the primary driving gear 81 and relatively turnably supported by the input shaft 77, and the primary driven gear 82 is coupled to the clutch outer 78 relatively turnably supported by the input shaft 77 via the damper 80.

A cam chain-driving sprocket 84 for engaging a cam chain 83 therewith is arranged between the cylinder bore 56 and the clutch 59 in the axial direction of the crankshaft 51, in this embodiment, between the primary speed-reduction device 79 and the cylinder bore 56, and the cam chain-driving sprocket 84 is integrated with the crankshaft 51.

A right crankcase cover 86 having an opening 85 opposite to a portion of the clutch 59 is fastened to the right case half 28R so as to cover a portion of the primary speed-reduction device 79, and a clutch cover 87 covering the clutch 59 is fastened to the right crankcase cover 86 so as to close the opening 85.

The clutch 59 is provided with the clutch outer 78, plural friction plates 88, a clutch inner 89, plural friction plates 90, a pressure receiving plate 91, a pressing member 92, a clutch spring 93, and a lifter 95. The clutch outer 78 is relatively turnably supported by one end of the input shaft 77, the plural friction plates 88 are engaged with the clutch outer 78, the clutch inner 89 is relatively non-turnably connected to the input shaft 77, the plural friction plates 90 are arranged alternately with the friction plates 88 and engaged with the clutch inner 89, the pressure receiving plate 91 is opposite to the axially inside friction plate out of the alternately arranged friction plates 88, 90, the pressure receiving plate 91 being integrated with the clutch inner 89, the pressing member 92 holds the alternately arranged friction plates 88, 90 between the pressing member 92 and the pressure receiving plate 91, the clutch spring 93 biases the pressing member 92 in a direction where the friction plates 88, 90 are fixed by applying pressure between the clutch spring 93 and the pressure receiving plate 91, and the lifter 95 is coupled to an inner peripheral portion of the pressing member 92 via a release bearing 94.

The input shaft 77 of the transmission 52 is formed in the shape of a cylinder having a hollow inside, a pressing rod 96 having one end abutting against the lifter 95 is axially movably inserted into the input shaft 77, and the clutch 59 disconnects transmission of power between the clutch outer 78 and the clutch inner 89 when the lifter 95 is pressed by the pressing rod 96.

The pressing rod 96 is axially driven by turning a release rod 98 of a clutch release lever 97 (see FIG. 2) and the release rod 98 coupled to the other end of the pressing rod 96 via a cam mechanism 99 is turnably supported by the crankcase cover 62.

Figure 6:
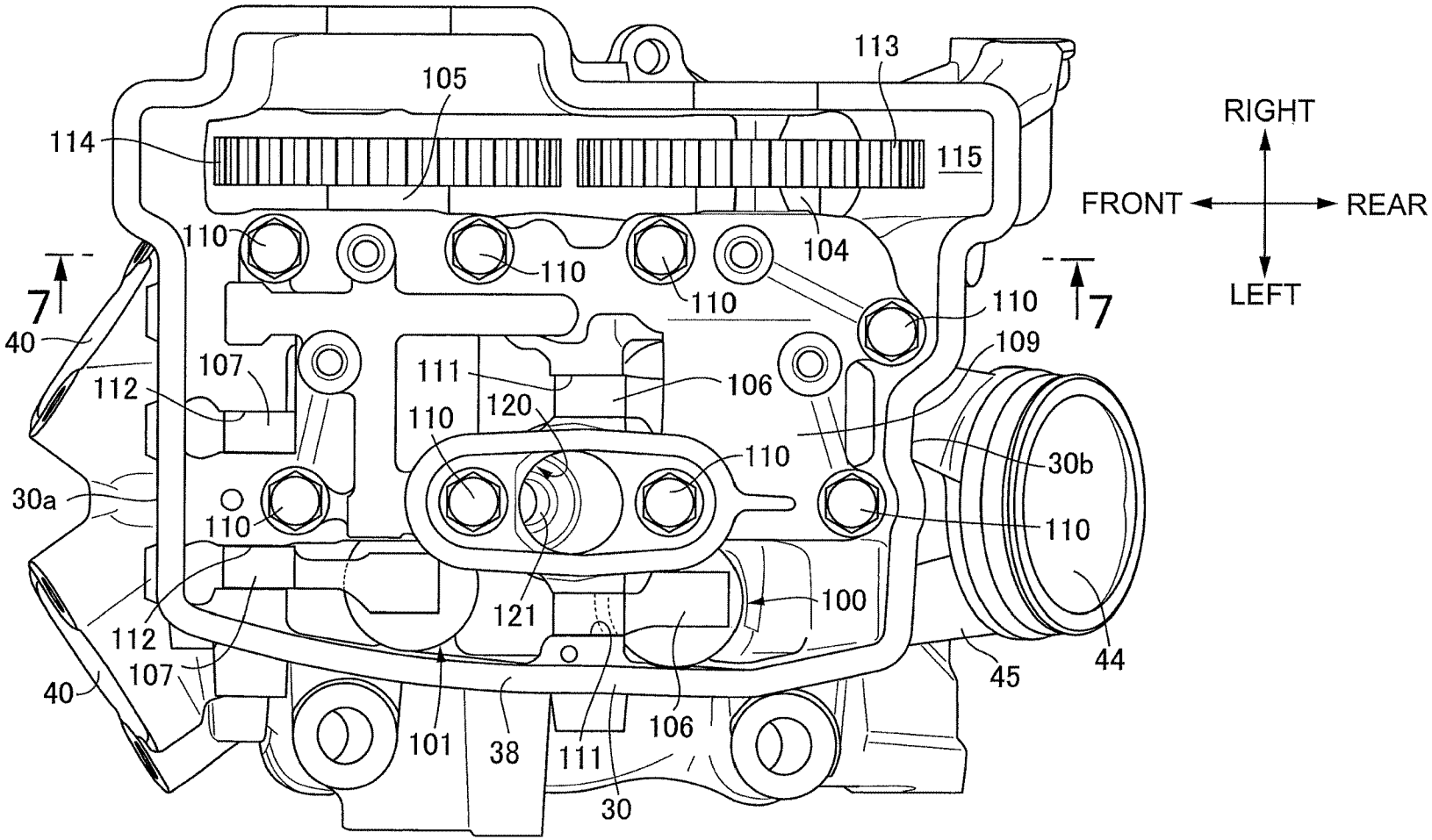
FIG. 6 is a view of a cylinder head when viewed in a direction of an arrowed line 6-6 in FIG. 2.
Figure 7:
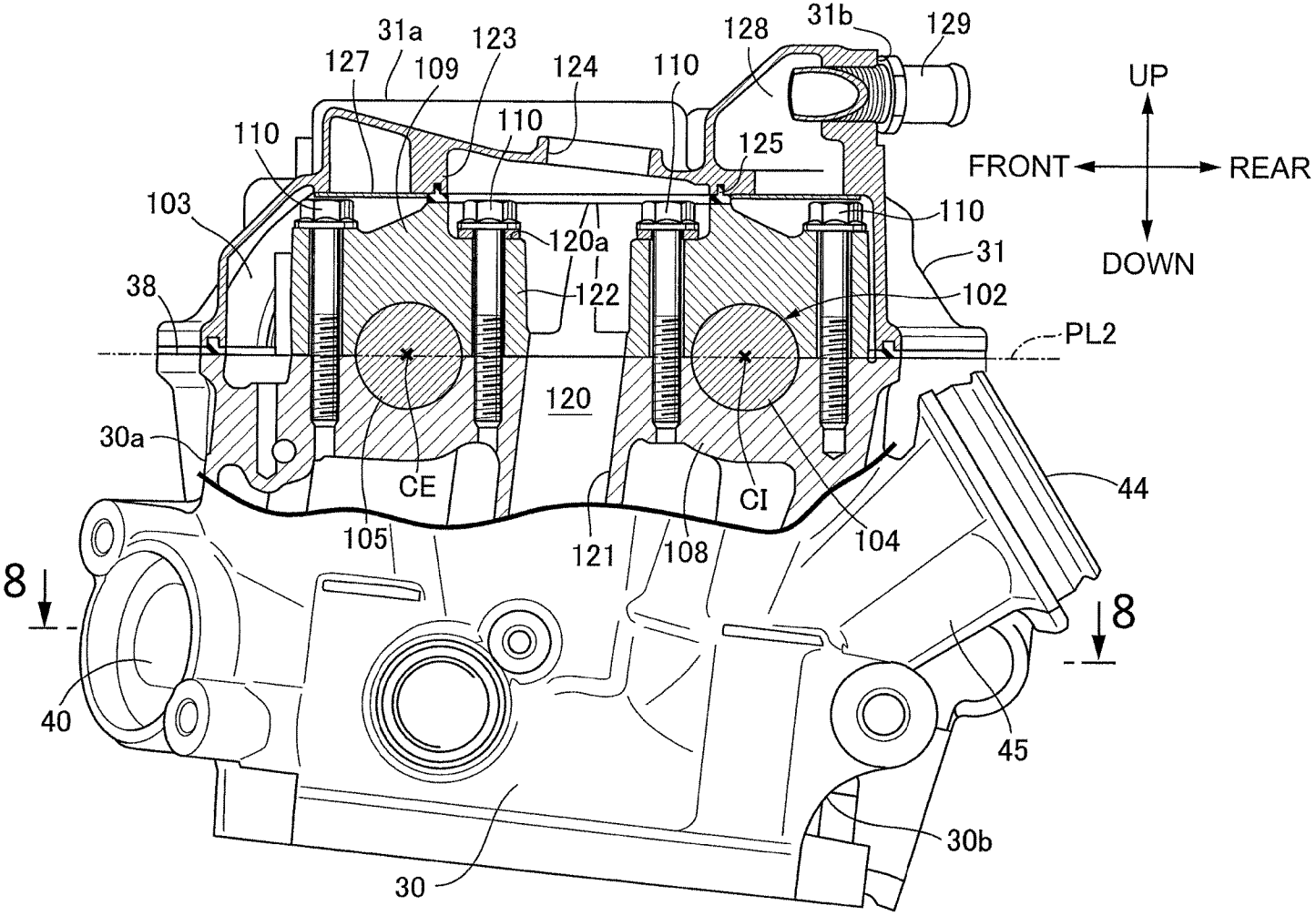
FIG. 7 is a longitudinal sectional view of the cylinder head and a head cover which is viewed along a line 7-7 in FIG. 6.
Figure 8:
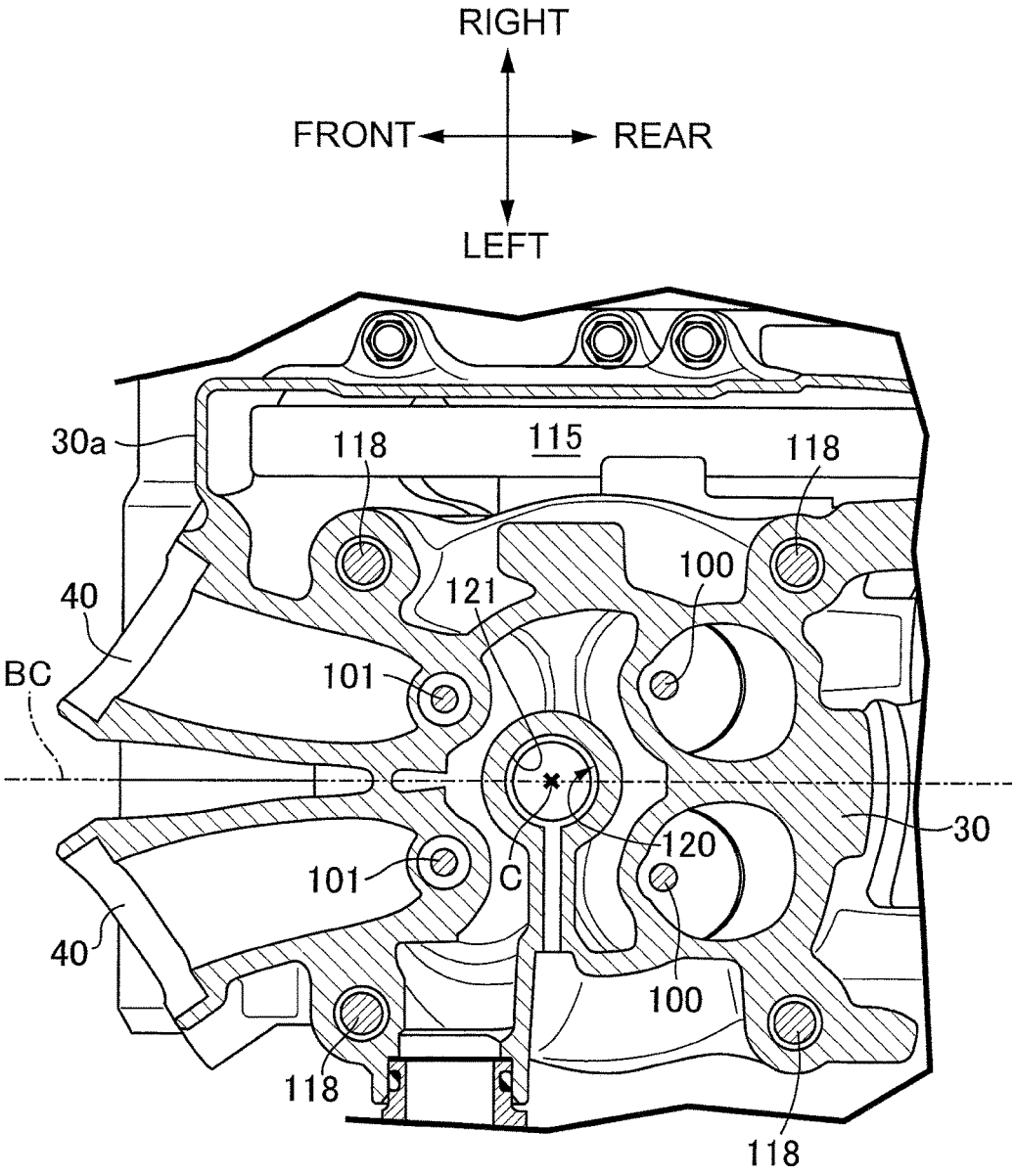
FIG. 8 is a sectional view viewed along a line 8-8 in FIG. 7.

As also shown in FIGS. 6 to 8, the cylinder head 30 and the cylinder body 29 are fastened to the crankcase 28 by a plurality of through bolts 118 inserted through the cylinder head 30 and the cylinder body 29 and screwed into the crankcase 28. Besides, in the cylinder head 30, there are disposed a pair of intake valves 100 arranged in the vehicle width direction and a pair of exhaust valves 101 arranged in the vehicle width direction in front of the intake valves 100 in the longitudinal direction of the vehicle so that the intake valves 100 and the exhaust valves 101 can be opened and closed, and a valve chamber 103 for housing a valve train 102 that opens/closes the intake valve 100 and the exhaust valve 101 is formed between the cylinder head 30 and the head cover 31.

The pair of exhaust ports 40 respectively correspond to the pair of exhaust valves 101 and are formed in the cylinder head 30 mutually independently so as to open to a front wall 30*a* of the cylinder head 30, the pair of exhaust ports 40 being arranged on opposite sides of a center line of a vehicle body BC passing the center in the vehicle width direction of the down frame 15 as seen in a plan view.

The valve train 102 is provided with an intake side camshaft 104, an exhaust side camshaft 105, a pair of intake side rocker arms 106, and a pair of exhaust side rocker arms 107. The intake side camshaft 104 and the exhaust side camshaft 105 are extended in the vehicle width direction in positions apart in the longitudinal direction of the vehicle, the pair of intake side rocker arms 106 are swung according to turning of the intake side camshaft 104 so as to open and close the intake valve 100, and the pair of exhaust side rocker arms 107 are swung according to turning of the exhaust side camshaft 105 so as to open and close the exhaust valve 101.

The intake side camshaft 104 and the exhaust side camshaft 105 are turnably supported by a shaft supporting portion 108 integrated with the cylinder head 30 and a cam holder 109 fastened to the shaft supporting portion 108. The cam holder 109 is fastened to the shaft supporting portion 108 of the cylinder head 30 by plural, for example, eight cam holder joining bolts 110. Rotational axes CI, CE of the intake side camshaft 104 and the exhaust side camshaft 105 respectively turnably supported by the shaft supporting portion 108 and the cam holder 109 are located on the same plane as the joining surface 38 of the cylinder head 30 to the head cover 31, that is, on the second plane PL2.

A base of the intake side rocker aim 106 is arranged in a slit 111 formed in the shaft supporting portion 108 of the cylinder head 30 in front of the intake side camshaft 104 in the longitudinal direction of the vehicle and swingably supported by an intake side rocker shaft (not shown) fixed to the shaft supporting portion 108. Besides, a base of the exhaust side rocker arm 107 is arranged in a slit 112 formed in the shaft supporting portion 108 of the cylinder head 30 in front of the exhaust side camshaft 105 in the longitudinal direction of the vehicle and swingably supported by an exhaust side rocker shaft (not shown) fixed to the shaft supporting portion 108.

Driven sprockets 113, 114 are fixed to respective protruded ends of the intake side camshaft 104 and the exhaust side camshaft 105 respectively protruded from a right end in the vehicle width direction of the cam holder 109, and the cam chain 83 that transmits rotational power to the intake side camshaft 104 and the exhaust side camshaft 105 is wound onto the driven sprockets 113, 114. In addition, a cam chain passage 115 through which the cam chain 83 is traveled is formed in the crankcase 28, the cylinder body 29 and the cylinder head 30. Additionally, a curve cover 116 curved to cover the driven sprockets 113, 114 is formed on the right side in the vehicle width direction of the head cover 31.

A plug hole 120 for inserting thereinto an ignition plug (not shown) attached to the cylinder head 30 is provided so as to straddle between the cylinder head 30 and the head cover 31 connected to the cylinder head 30. The plug hole 120 is configured with a plug opening 121, a cam holder side tube portion 122, a head cover side tube portion 123 and a through hole 124. The plug opening 121 is formed in the shaft supporting portion 108 of the cylinder head 30, the cam holder side tube portion 122 is integrated with the cam holder 109 so as to be connected to the plug opening 121, and the head cover side cylinder portion 123 is integrally provided in the head cover 31 so that a gasket 125 is interposed between the head cover side tube portion 123 and an upper end of the cam holder side tube portion 122, and the through hole 124 is provided to a ceiling wall 31*a* of the head cover 31 so as to be connected to the head cover side tube portion 123.

A portion of the gasket 125 interposed between the cam holder side tube portion 122 and the head cover side tube portion 123 is integrally connected to a portion interposed between the cylinder head 30 and the head cover 31.

A stepped portion 120*a* opposite to the head cover 31 side is formed in a portion of the plug hole 120 corresponding to the cam holder side tube portion 122. The two cam holder joining bolts 110 arranged between the intake side camshaft 104 and the exhaust side camshaft 105 out of the eight cam holder joining bolts 110 for fastening the cam holder 109 to the shaft supporting portion 108 of the cylinder head 30 are each inserted into the stepped portion 120*a*.

A breather plate 127 is fastened to the head cover 31, a breather chamber 128 encircling the plug hole 120 is formed between the breather plate 127 and the ceiling wall 31*a* of the head cover 31, and a lead-out pipe 129 for leading out breather gas from the breather chamber 128 is installed in a rear wall 31*b* of the head cover 31.

The throttle body 47 is provided with a butterfly throttle valve 130 and an axis of a valve stem 131 of the throttle valve 130 is arranged on the second plane PL2 on which the joining surface 38 of the cylinder head 30 to the head cover 31 is arranged. In addition, a throttle drum 132 is fixed to one end on the right side in the vehicle width direction of the valve stem 131, the throttle drum 132 is housed in a drum housing box 135 configured with a body 133 of the throttle body 47 and a lid member 134 fastened to the body 133 from the right side in the vehicle width direction, the drum housing box 135 is arranged close to the curve cover 116 of the head cover 31, and throttle cables 137, 138 wound onto the throttle drum 132 are extended upward from the drum housing box 135.

Figure 9:
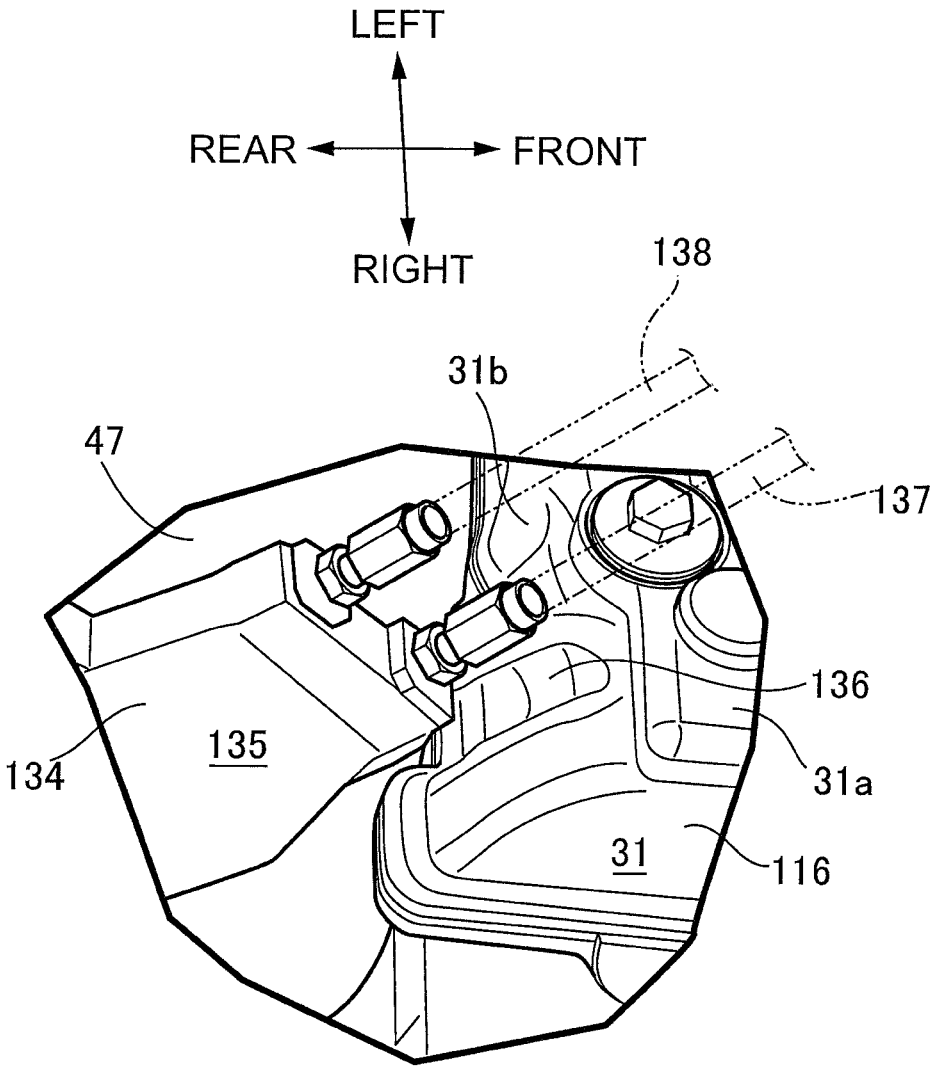
FIG. 9 is a perspective view of a drum housing box and its vicinity when viewed from the right diagonal upside.
Figure 10:
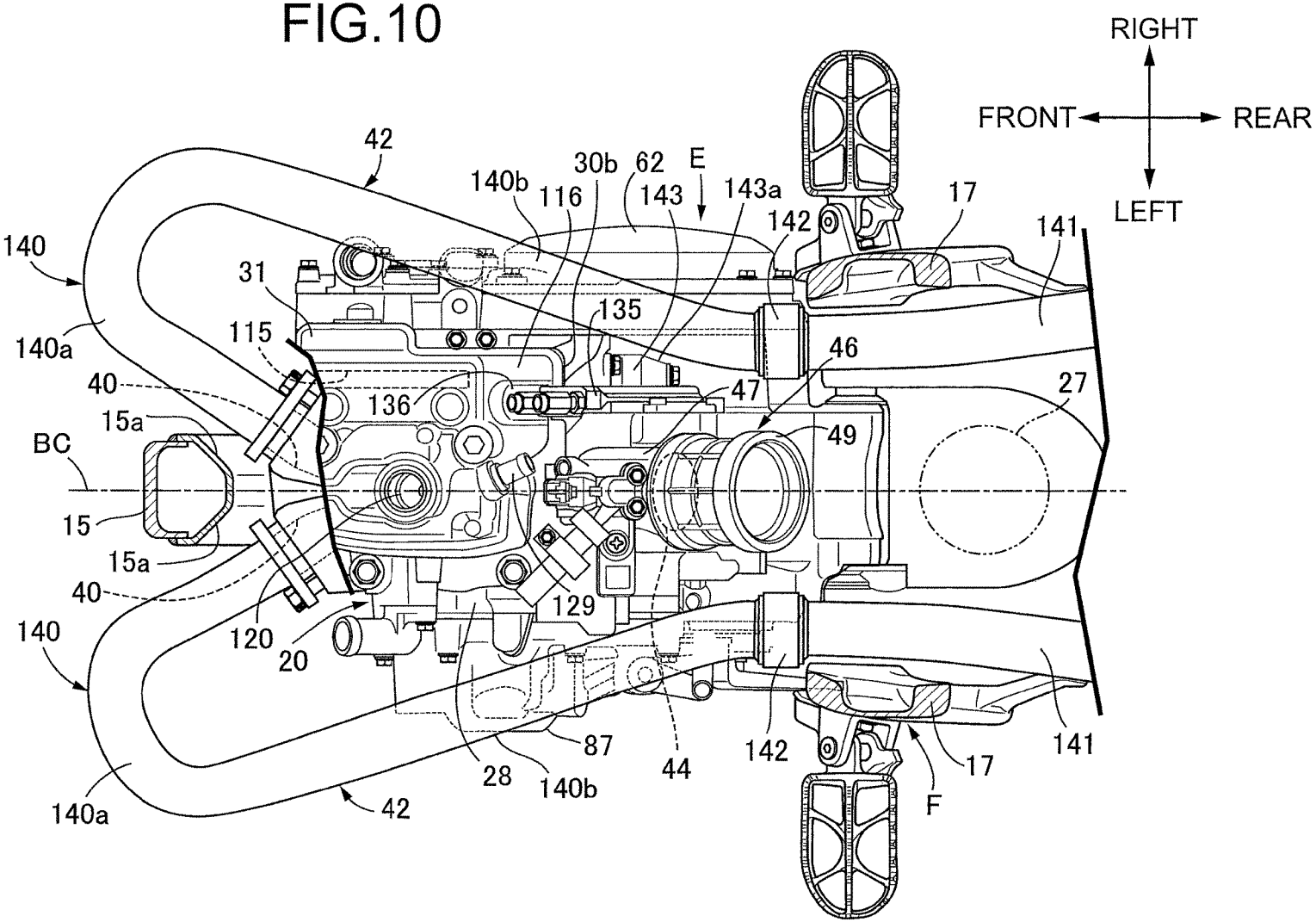
FIG. 10 is a cross sectional plan view viewed along a line 10-10 in FIG. 1.

As also shown in FIGS. 9, 10, a relief recess 136 corresponding to the drum housing box 135 is formed on the rear wall 31*b* of the head cover 31 and the relief recess 136 is arranged between the cam chain passage 115 and the lead-out pipe 129 when viewed from a direction along the cylinder axis C.

The exhaust pipe 42 is configured with a first pipe member 140 and a second pipe member 141. The first pipe member 140 has an upstream end connected to the exhaust port 40 of the cylinder head 30, and the second pipe member 141 is connected to a downstream end of the first pipe member 140 via a joint 142 and extended backward, the second pipe member 141 having a downstream end connected to the exhaust muffler 43.

The first pipe member 140 of the exhaust pipe 42 is integrally provided with a curved pipe portion 140*a* and an inclined linear pipe portion 140*b*. The curved pipe portion 140*a* has an upstream end connected to the exhaust port 40 and is bent in a U shape beside the down frame 15. The inclined linear pipe portion 140*b* has an upstream end connected to a downstream end of the curved pipe portion 140*a* and is extended backward so as to be inclined to be located inside in the vehicle width direction as going toward the rear. The inclined linear pipe portion 140*b* and the second pipe member 141 are arranged in such a manner that they pass between the pair of right and left pivot frames 17.

In addition, a cam chain tensioner 143 that adjusts tension of the cam chain 83 is provided to the rear wall 30*b* on the right side in the vehicle width direction of the cylinder head 30, and an inclined face 143*a* along the inclined linear pipe portion 140*b* of the exhaust pipe 42 on the right side in the vehicle width direction out of the pair of exhaust pipes 42 is formed in a protruded portion of the cam chain tensioner 143 protruded from the rear wall 30*b* of the cylinder head 30.

Besides, the second pipe members 141 of the pair of right and left exhaust pipes 42 are extended backward, passing respectively between the pair of right and left pivot frames 17 and the rear cushion unit 27, and the exhaust muffler 43 is individually connected to the downstream end of the exhaust pipe 42, that is, to the downstream end of the second pipe member 141.

Moreover, the down frame 15 has a pair of side walls 15*a* that are inclined so as to approach each other as going toward the rear in the longitudinal direction of the vehicle, while being opposite to the curved pipe portion 140*a* of the exhaust pipe 42, and the center of the down frame 15, the cylinder axis C and the center of the intake port 44 are arranged on the center line of the vehicle body BC as seen in the plan view.

Next, the operation of this embodiment will be described. The joining surface 38 of the cylinder head 30 to the head cover 31 in the single-cylinder engine main unit 20 mounted on the body frame F is formed on the second plane PL2 that crosses the cylinder axis C and is inclined downward toward the front, and the rotation axes CI, CE of the intake side and exhaust side camshafts 104, 105 respectively configuring a part of the valve train 102 that opens and closes the pair of intake valves 100 and the pair of exhaust valves 101 respectively supported by the cylinder head 30 are arranged on the second plane PL2. Besides, the axis of the valve stem 131 of the butterfly throttle valve 130 provided to the throttle body 47 configuring a part of the intake system 46 connected to the rear wall 30*b* of the cylinder head 30 is arranged on the second plane PL2, the curve cover 116 curved to cover the driven sprockets 113, 114 that are respectively fixed to the intake side and exhaust side camshafts 104, 105 so that the cam chain 83 for transmitting power to the intake side and exhaust side camshafts 104, 105 from the crankshaft 51 is wound onto the driven sprockets 113, 114 is formed on one side in the vehicle width direction of the head cover 31, and the drum housing box 135 that houses the throttle drum 132 fixed to one end of the valve stem 131 and is annexed to the throttle body 47 is arranged close to the curve cover 116. For the reasons described above, the throttle valve 130 can be brought closer to the engine main unit 20, concentration and compactness of the intake system 46 can be achieved, the intake system 46 can be made a greatly inclined downdraft type, accordingly, the output of the internal combustion engine E can be enhanced, and besides, the handling of the throttle cables 137, 138 extended from the drum housing box 135 can be also facilitated.

Besides, as the relief recess 136 corresponding to the drum housing box 135 is formed on the rear wall 31*b* of the head cover 31, the drum housing box 135 can be brought closer to the head cover 31 side and further concentration and compactness of the intake system 46 can be achieved.

Moreover, as the cam chain passage 115 through which the cam chain 83 is traveled is formed in the engine main unit 20, the lead-out pipe 129 for leading out breather gas is installed in the rear wall 31*b* of the head cover 31, and the relief recess 136 is arranged between the cam chain passage 115 and the lead-out pipe 129 when viewed from the direction along the cylinder axis C, a dead space can be effectively utilized.

In addition, as the engine main unit 20 is arranged in such a manner that it is encircled by the head pipe 13, the main frames 14, the pivot frames 17 and the down frame 15 as seen in the side view, and the pair of exhaust ports 40 respectively corresponds to the pair of exhaust valves 101 that are arranged in the cylinder head 30 so as to be able to be opened and closed, the pair of exhaust ports 40 being open to the front wall 30*a* of the cylinder head 30 and mutually independently formed in the cylinder head 30 so that the exhaust ports 40 are arranged on opposite sides of the center line of the vehicle body BC passing the center in the vehicle width direction of the down frame 15 as seen in the plan view, a curve of the exhaust port 40 is reduced so that the output is enhanced, and the cylinder head 30 can be arranged close to the down frame 15, readily avoiding interference with the exhaust pipes 42 connected to the pair of exhaust ports 40.

Further, the upstream ends of the exhaust pipes 42 respectively connected to the pair of exhaust ports 40 while configuring a part of the exhaust system 41 are connected to the exhaust ports 40, and each of the exhaust pipes 42 is integrally provided with the curved pipe portion 140*a* bent in the U shape beside the down frame 15 and having the upstream end connected to the exhaust port 40 and the inclined linear pipe portion 140*b* having the upstream end connected to the downstream end of the curved pipe portion 140*a*, the inclined linear pipe portion 140*b* being extended backward and inclined so as to be located inside in the vehicle width direction as going toward the rear. Besides, the inclined linear pipe portions 140*b* are arranged in such a manner as passing between the pair of right and left pivot frames 17 and the inclined face 143*a* along the inclined linear pipe portion 140*b* of one of the pair of exhaust pipes 42 is formed in the protruded portion of the cam chain tensioner protruded from the rear wall 30*b* of the cylinder head 30, the cam chain tensioner 143 being provided to the rear wall 30*b* of the cylinder head 30 so as to adjust the tension of the cam chain 83. For the reasons described above, compact arrangement of the pair of exhaust pipes 42 is enabled, avoiding interference with the cam chain tensioner 143.

Furthermore, as the rotor 60 of the generator 58 is fixed to one end of the crankshaft 51, the cam chain-driving sprocket 84 for engaging therewith the cam chain 83 is provided on the other end side of the crankshaft 51 in a portion where the cylinder bore 56 of the cylinder body 29 is sandwiched between the portion and the generator 58, and the power transmission mechanism 64 for starting that transmits, to the crankshaft 51, power for starting from the starter motor 63 attached to the crankcase 28 is arranged between the generator 58 and the cylinder bore 56, a sideway overhang of the cam chain passage 115 from the cylinder bore 56 is inhibited, the exhaust pipes 42 can be arranged closer to the center side of the vehicle body beside the cylinder body 29 and the cylinder head 30, and the more compact arrangement of the exhaust pipes 42 is enabled.

Furthermore, as the front end of the swing arm 22 that has the rear end pivotally supporting the rear wheel WR is swingably supported by the pivot frames 17 via the pivot 23, the rear cushion unit 27 that buffers the swing of the swing aim 22 is extended up and down and arranged between the pair of right and left pivot frames 17, the pair of right and left exhaust pipes 42 are extended backward, respectively passing between the pair of right and left pivot frames 17 and the rear cushion unit 27, and the exhaust muffler 43 is individually connected to the downstream end of each of the exhaust pipes 42, the right and left exhaust pipes 42 are made similar and symmetrical, and a part of materials configuring the exhaust pipes 42 can be shared for the right and left exhaust pipes 42.

Furthermore, as the down frame 15 is provided with the pair of side walls 15*a* that are inclined so as to approach each other as going toward the rear in the longitudinal direction of the vehicle while being opposite to the curved pipe portion 140*a* of the exhaust pipe 42, a space for arranging the exhaust pipes 42 can be readily secured on opposite sides of the down frame 15, and the curve of the exhaust pipe 42 is reduced so that exhaust performance can be enhanced.

Furthermore, as the center in the vehicle width direction of the down frame 15, the cylinder axis C and the center of the intake port 44 open to the rear wall 30*b* of the cylinder head 30 are arranged on the center line of the vehicle body BC as seen in the plan view, an influence of bias in the right-left direction of intake and exhaust is inhibited to be small so that the output can be enhanced.

The embodiment of the present invention has been described above, however, the present invention is not limited to the above-mentioned embodiment and various design variations can be made without deviating from the gist of the present invention.

What is claimed is:

1. A saddle-ride type vehicle in which a single-cylinder engine main unit is mounted on a body frame, the engine main unit having: a crankcase; a cylinder body rising upward from an upper portion of the crankcase; a cylinder head connected to an upper portion of the cylinder body; and a head cover connected to an upper portion of the cylinder head, the cylinder head includes a front wall connected to an exhaust system and a rear wall connected to an intake system, wherein a joining surface of the cylinder head to the head cover is formed on a plane crossing a cylinder axis, the plane being inclined downward toward a front, rotation axes of camshafts are arranged on the plane, the rotation axes of camshafts configuring a part of a valve train opening/closing an intake valve and an exhaust valve respectively supported by the cylinder head, an axis of a valve stem of a butterfly throttle valve is arranged on the plane, the butterfly throttle valve being provided to a throttle device configuring a part of the intake system, a curve cover is formed on one side in a vehicle width direction of the head cover, the curve cover being curved to cover driven sprockets that are fixed to the camshafts so that a cam chain for transmitting power from a crankshaft to the camshafts is wound around the driven sprockets, and a drum housing box is arranged close to the curve cover, the drum housing box housing a throttle drum fixed to one end of the valve stem, the drum housing box being annexed to the throttle device.

2. The saddle-ride type vehicle according to claim 1, wherein the head cover includes a rear wall formed with a relief recess corresponding to the drum housing box.

3. The saddle-ride type vehicle according to claim 2, wherein a cam chain passage through which the cam chain is traveled is formed in the engine main unit, a lead-out pipe for leading out breather gas is installed in the rear wall of the head cover, and the relief recess is arranged between the cam chain passage and the lead-out pipe when viewed from a direction along the cylinder axis.

4. The saddle-ride type vehicle according to claim 1, wherein the body frame includes:

a head pipe that steerably supports a steering handlebar;

a pair of right and left main frames extended backward from the head pipe;

a pair of right and left pivot frames connected to rear ends of the main frames, the pair of pivot frames being extended downward; and a single down frame extended downward from the head pipe, the engine main unit is arranged so as to be encircled by the head pipe, the main frames, the pivot frames and the down frame as seen in a side view, and a pair of exhaust ports are mutually independently formed in the cylinder head so that the pair of exhaust ports are arranged on opposite sides of a center line of a vehicle body passing a center in the vehicle width direction of the down frame as seen in a plan view, the pair of exhaust ports respectively corresponding to a pair of exhaust valves openably and closably arranged in the cylinder head, the pair of exhaust ports being open to the front wall of the cylinder head.

5. The saddle-ride type vehicle according to claim 4, wherein exhaust pipes configuring a part of the exhaust system and respectively connected to the pair of exhaust ports integrally includes:

a curved pipe portion having an upstream end connected to each exhaust port, the curved pipe portion being bent in a U shape beside the down frame; and an inclined linear pipe portion having an upstream end connected to a downstream end of the curved pipe portion, the inclined linear pipe portion being extended backward while inclined to be located inside in the vehicle width direction as going toward the rear, the inclined linear pipe portions are arranged so as to pass between the pair of right and left pivot frames, and an inclined face along the inclined linear pipe portion of one of the pair of exhaust pipes is formed in a protruded portion of a cam chain tensioner protruded from the rear wall of the cylinder head, the cam chain tensioner being provided to the rear wall of the cylinder head so as to adjust tension of the cam chain.

6. The saddle-ride type vehicle according to claim 5, wherein a rotor of a generator is fixed to one end of the crankshaft, a cam chain-driving sprocket for engaging the cam chain therewith is provided to an other end side of the crankshaft in a portion where a cylinder bore of the cylinder body is sandwiched between the portion and the generator, and a power transmission mechanism for starting that transmits power for starting from a starter motor installed in the crankcase to the crankshaft is arranged between the generator and the cylinder bore.

7. The saddle-ride type vehicle according to claim 6, wherein a front end of a swing arm is swingably supported by the pivot frames via a pivot, a rear end of the swing arm pivotally supporting a rear wheel, a rear cushion unit that buffers a swing of the swing arm is extended up and down and the rear cushion unit is arranged between the pair of right and left pivot frames, the pair of right and left exhaust pipes pass respectively between the pair of right and left pivot frames and the rear cushion unit and are extended backward, and exhaust mufflers are respectively connected to downstream ends of the exhaust pipes.

8. The saddle-ride type vehicle according to claim 6, wherein the down frame is provided with a pair of side walls that are inclined so as to approach each other as going to the rear in a longitudinal direction of the vehicle while respectively facing the curved pipe portions of the exhaust pipes.

9. The saddle-ride type vehicle according to claim 7, wherein the down frame is provided with a pair of side walls that are inclined so as to approach each other as going to the rear in a longitudinal direction of the vehicle while respectively facing the curved pipe portions of the exhaust pipes.

10. The saddle-ride type vehicle according to claim 4, wherein a center in the vehicle width direction of the down frame, the cylinder axis and a center of an intake port open to the rear wall of the cylinder head are arranged on the center line of the vehicle body as seen in the plan view.

11. The saddle-ride type vehicle according to claim 5, wherein a center in the vehicle width direction of the down frame, the cylinder axis and a center of an intake port open to the rear wall of the cylinder head are arranged on the center line of the vehicle body as seen in the plan view.

* * * * *